US011506449B2

(12) United States Patent
Uchida et al.

(10) Patent No.: US 11,506,449 B2
(45) Date of Patent: Nov. 22, 2022

(54) REFRIGERATOR AND REFRIGERATOR SYSTEM

(71) Applicant: Mitsubishi Electric Corporation, Tokyo (JP)

(72) Inventors: Tsuyoshi Uchida, Tokyo (JP); Satoshi Minezawa, Tokyo (JP); Eiji Niikura, Tokyo (JP); Yoko Inoue, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 222 days.

(21) Appl. No.: 16/766,034

(22) PCT Filed: Nov. 27, 2017

(86) PCT No.: PCT/JP2017/042403

§ 371 (c)(1),
(2) Date: May 21, 2020

(87) PCT Pub. No.: WO2019/102616

PCT Pub. Date: May 31, 2019

(65) Prior Publication Data

US 2020/0363125 A1 Nov. 19, 2020

(51) Int. Cl.
*F25D 29/00* (2006.01)
*F25D 23/02* (2006.01)

(52) U.S. Cl.
CPC ..... *F25D 29/005* (2013.01); *F25D 23/028* (2013.01); *F25D 2400/36* (2013.01);
(Continued)

(58) Field of Classification Search
CPC .. F25D 29/005; F25D 23/028; F25D 2400/36; F25D 2500/06; F25D 2700/02; F25D 2700/06
See application file for complete search history.

(56) References Cited

U.S. PATENT DOCUMENTS

2012/0048042 A1 3/2012 Tanaka
2014/0293060 A1* 10/2014 Ryu ..... H04N 5/2252 348/159
(Continued)

FOREIGN PATENT DOCUMENTS

CN 103927755 A 7/2014
CN 105164481 A 12/2015
(Continued)

OTHER PUBLICATIONS

Office Action dated Dec. 24, 2021, issued in corresponding Korean Patent Application No. 10-2020-7013804 and English Machine Translation).
(Continued)

*Primary Examiner* — Nelson J Nieves
(74) *Attorney, Agent, or Firm* — Posz Law Group, PLC

(57) ABSTRACT

A refrigerator includes: a main body having a storeroom for storing a food item; a shelf plate arranged in a storeroom, the shelf plate on which a food item is put; a door that opens and closes a side of the storeroom; a camera arranged on an inner surface of the door, the camera takes an image of an inside of the storeroom; a camera moving device that moves the camera in a vertical direction. The camera moving device stops the camera at one or more points for each of between the shelf plates located adjacent to each other, and between an inner surface of a top edge of the storeroom and the shelf plate located adjacent to the inner surface of the top edge of the storeroom, and the camera takes an image each time when the camera moving device stops moving the camera.

12 Claims, 15 Drawing Sheets

(52) U.S. Cl.
CPC ..... *F25D 2500/06* (2013.01); *F25D 2700/02* (2013.01); *F25D 2700/06* (2013.01)

(56) References Cited

U.S. PATENT DOCUMENTS

| | | | | |
|---|---|---|---|---|
| 2016/0088262 | A1 | 3/2016 | Lee et al. | |
| 2016/0138859 | A1 | 5/2016 | Stimpfig et al. | |
| 2016/0182864 | A1 | 6/2016 | Izawa et al. | |
| 2016/0203591 | A1* | 7/2016 | Justaniah | G06T 7/0004 348/89 |
| 2017/0219276 | A1* | 8/2017 | Wang | G06V 10/454 |
| 2017/0234602 | A1* | 8/2017 | Seo | H04N 7/183 348/151 |
| 2018/0245840 | A1* | 8/2018 | Chen | F25D 29/00 |

FOREIGN PATENT DOCUMENTS

| | | | |
|---|---|---|---|
| CN | 107270627 | A | 10/2017 |
| EP | 2843336 | A1 | 3/2015 |
| JP | 2005-276992 | A | 10/2005 |
| JP | 3738196 | B2 | 1/2006 |
| JP | 2007-046833 | A | 2/2007 |
| JP | 2012-055031 | A | 3/2012 |
| JP | 2014-196835 | A | 10/2014 |
| JP | 2014-196838 | A | 10/2014 |
| JP | 2015-065630 | A | 4/2015 |
| JP | 2015-154259 | A | 8/2015 |
| JP | 2016-057022 | A | 4/2016 |
| JP | 2016-148503 | A | 8/2016 |
| JP | 2016-223735 | A | 12/2016 |
| JP | 2017-32158 | A | 2/2017 |
| JP | 2017-089913 | A | 5/2017 |
| KR | 10-2012-0117464 | A | 10/2012 |
| WO | 2009/138359 | A2 | 11/2009 |

OTHER PUBLICATIONS

Office Action dated Sep. 14, 2021 issued in corresponding JP Patent Application No. 2019-556075 (and English Machine Translation).
Office Action dated Sep. 29, 2021 issued in corresponding CN Patent Application No. 201780097128.6 (and English machine translation).
Office Action dated Jun. 24, 2021 issued in corresponding KR Patent Application No. 10-2020-7013804 (and English Machine Translation).
International Search Report of the International Searching Authority dated Feb. 20, 2018 for the corresponding International application No. PCT/JP2017/042403 (and English translation).
Chinese Office Action dated Mar. 31, 2021, issued in corresponding Chinese Patent Application No. 201780097128.6 (and English Machine Translation).
Office Action dated May 18, 2021, issued in corresponding JP Patent Application No. 2019-556075 (and English Machine Translation).
Extended EP search report dated Oct. 14, 2020 in the corresponding EP patent application No. 17933157.4.
Office Action dated Feb. 24, 2021 issued in corresponding JP patent application No. 2019-556075 (and English machine translation).

* cited by examiner

FIG. 18

| FOOD TYPE | | SHAPE (OUTLINE) | SIZE (LONG AXIS) | COLOR (REPRESENTATIVE) | LABEL (CHARACTERS) |
|---|---|---|---|---|---|
| WATER (2L) | | RECTANGLE (FOUR EDGES) | 300mm | R:234 G:234 B:234 | Water |
| MILK (CARTON) | | RECTANGLE (FOUR EDGES) | 200mm | R:204 G:236 B:255 | Milk |
| JUICE (CARTON) | | RECTANGLE (FOUR EDGES) | 100mm | R:255 G:153 B:102 | Orange Apple |
| CANNED BEER (350mL) | | RECTANGLE (FOUR EDGES) | 120mm | R:102 G:102 B:153 | Beer MANUFACTURER A MANUFACTURER B |
| CONTAINER | | RECTANGLE (FOUR EDGES) | 140mm | R:0 G:153 B:204 | – |
| SALAD | | ELLIPSE (FOUR EDGES) | 150mm | R:51 G:204 B:51 | – |
| TOMATO | | ELLIPSE (NO EDGE) | 70mm | R:255 G:51 B:0 | – |
| CABBAGE | | ELLIPSE (NO EDGE) | 180mm | R:153 G:255 B:102 | – |
| BANANA | | RECTANGLE (FOUR EDGES) | 170mm | R:255 G:255 B:102 | – |
| | | | | | |

REFRIGERATOR AND REFRIGERATOR SYSTEM

CROSS REFERENCE TO RELATED APPLICATION

This application is a U.S. national stage application of International Application PCT/JP2017/042403 filed on Nov. 27, 2017, the contents of which are incorporated herein by reference.

TECHNICAL FIELD

The present invention relates to a refrigerator and a refrigerator system.

BACKGROUND

As a refrigerator including a camera that detects an image of an inside of the refrigerator, a refrigerator that takes an image while moving the camera from an upper end to a lower end of a moving range at predetermined fixed speed has been known (for example, see PTL 1).

PATENT LITERATURE

[PTL 1] JP 2016-148503 A

The refrigerator disclosed in PTL 1, however, takes an image while moving the camera at the fixed speed. Therefore, blurring occurs in the taken image. Further, depending on timing when the camera takes an image, a part showing a food item on a shelf plate inside a storeroom in the taken image may be largely distorted. Further, depending on timing when the camera takes an image, a food item located on an innermost side of the shelf plate may be hidden by a food item on a front side or by the shelf plate. Accordingly, the acquired image is not suitable for image recognition. If the acquired image is used for the image recognition, determination accuracy of a storage state inside the storeroom is deteriorated.

SUMMARY

The present invention is made to solve such issues. An object of the present invention is to provide a refrigerator and a refrigerator system that suppress blurring and distortion of an image and acquires a clearer storeroom image showing up to an innermost side of each shelf plate by a smaller number of cameras.

A refrigerator according to embodiments may include: a main body having a storeroom for storing a food item; a shelf plate arranged in a storeroom, the shelf plate configured for placing a food item thereon; a door configured to open and close a side of the storeroom; a camera arranged on an inner surface of the door, the camera configured to take an image of an inside of the storeroom; and a camera moving device configured to move the camera in a vertical direction, the camera moving device configured to stop the camera at least one point for each of between the shelf plates located adjacent to each other, and between an inner surface of a top edge of the storeroom and the shelf plate located adjacent to the inner surface of the top edge of the storeroom, the camera configured to take an image at each time when the camera moving device stops moving the camera.

A refrigerator system according to the present invention includes: the refrigerator described above; a communication device configured to transmit the image taken by the camera; and a terminal device provided to communicate with the communication device and configured to receive the image taken by the camera transmitted from the communication device.

The refrigerator and the refrigerator system according to the present invention achieve effects of suppressing blurring and distortion of the image and acquiring the clearer storeroom image showing up to the innermost side of each shelf plate by the smaller number of cameras.

BRIEF DESCRIPTION OF THE DRAWINGS

FIG. 18 is a diagram illustrating an example of contents stored in a food item image database of the refrigerator according to Embodiment 1 of the present invention.

DETAILED DESCRIPTION

Figure 1:
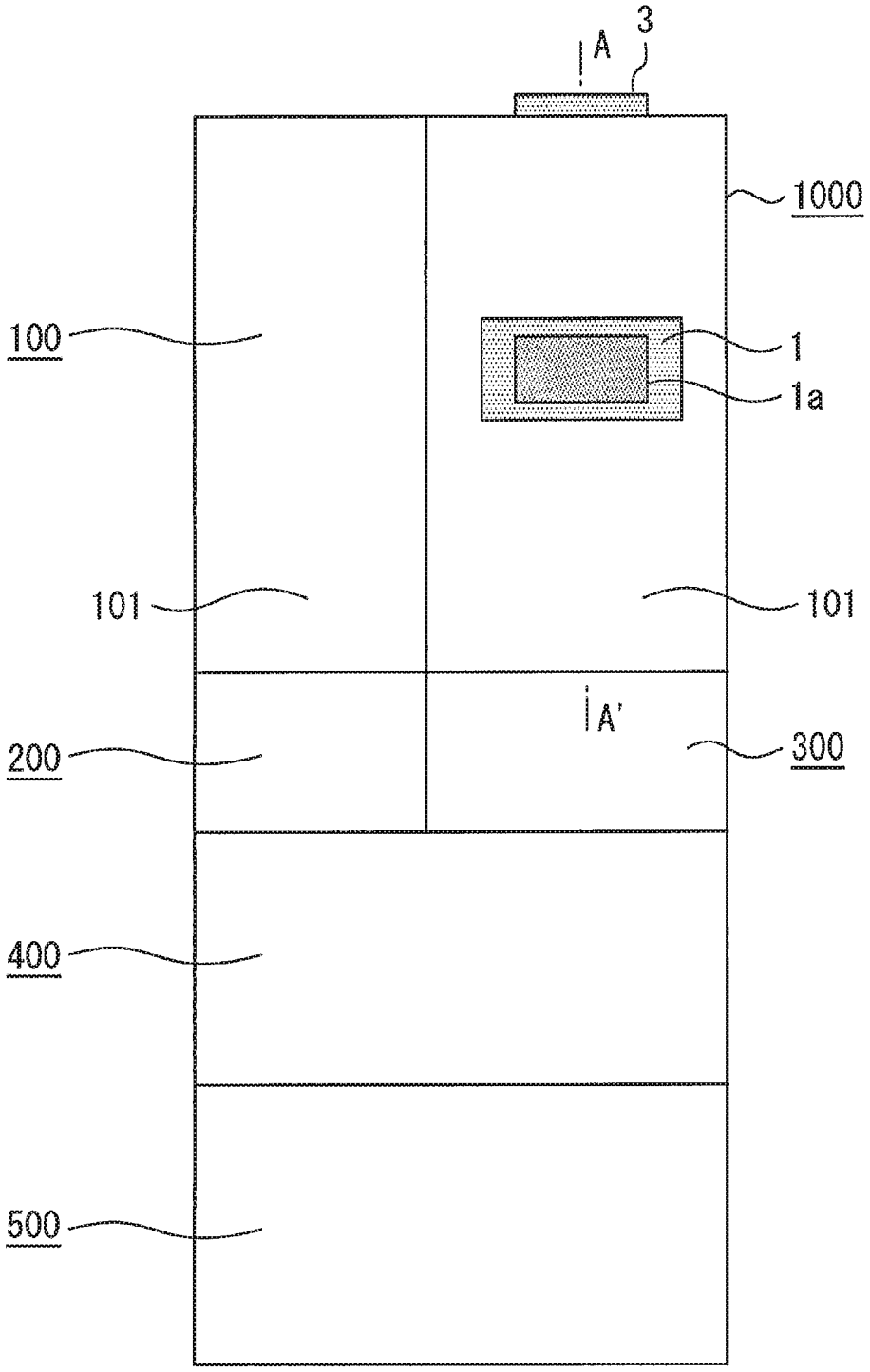
FIG. 1 is a front view of a refrigerator according to Embodiment 1 of the present invention.

Some embodiments of the present invention are described with reference to accompanying drawings. In the drawings, the same or equivalent components are denoted by the same reference numerals, and repetitive description is appropriately simplified or omitted. Note that the present invention is not limited to the following embodiments, and can be variously modified without departing from the scope of the present invention.

Embodiment 1

Figure 2:
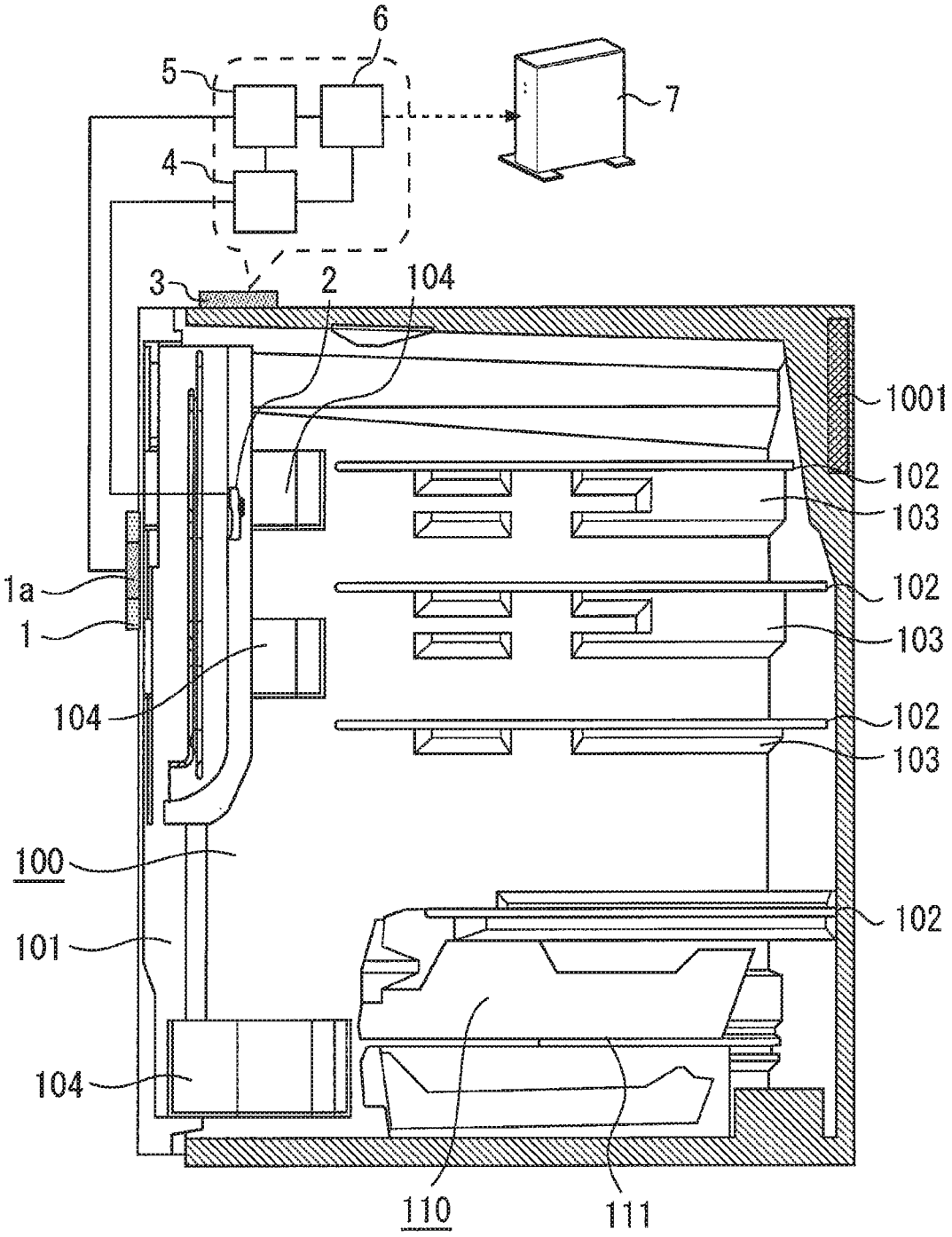
FIG. 2 is a cross-sectional view of the refrigerator according to Embodiment 1 of the present invention.
Figure 3:
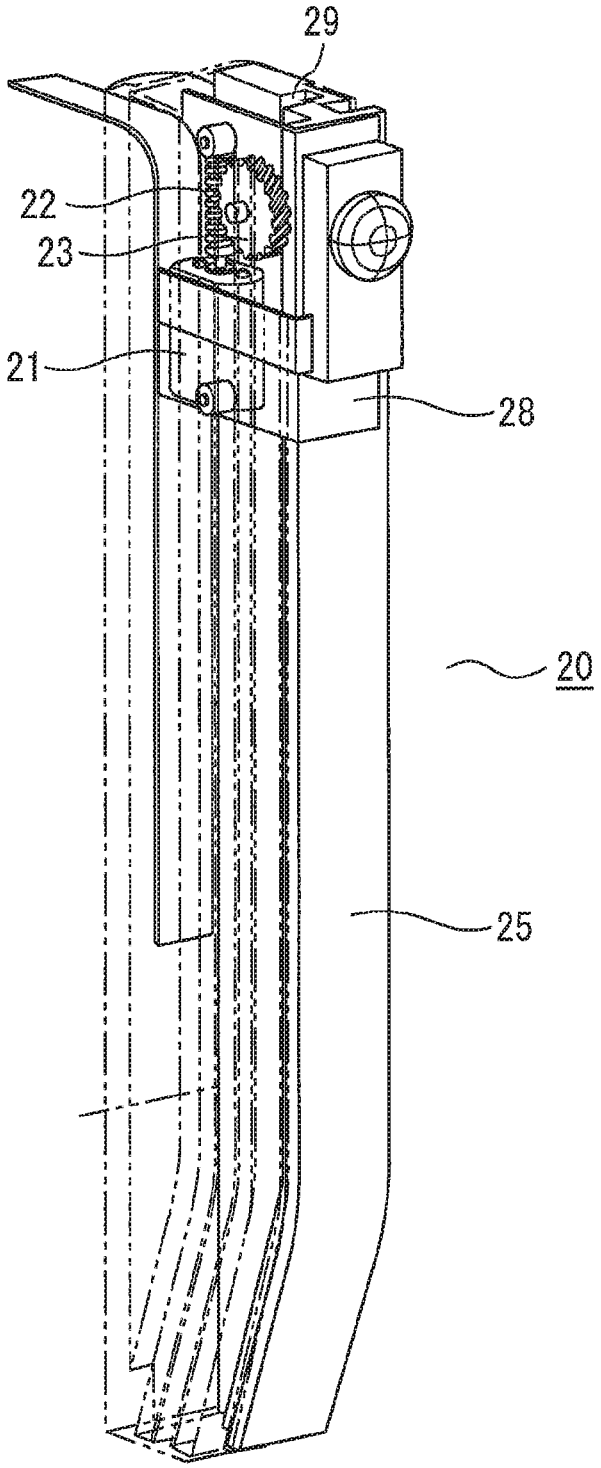
FIG. 3 is a perspective view of a camera moving device of the refrigerator according to Embodiment 1 of the present invention.
Figure 4:
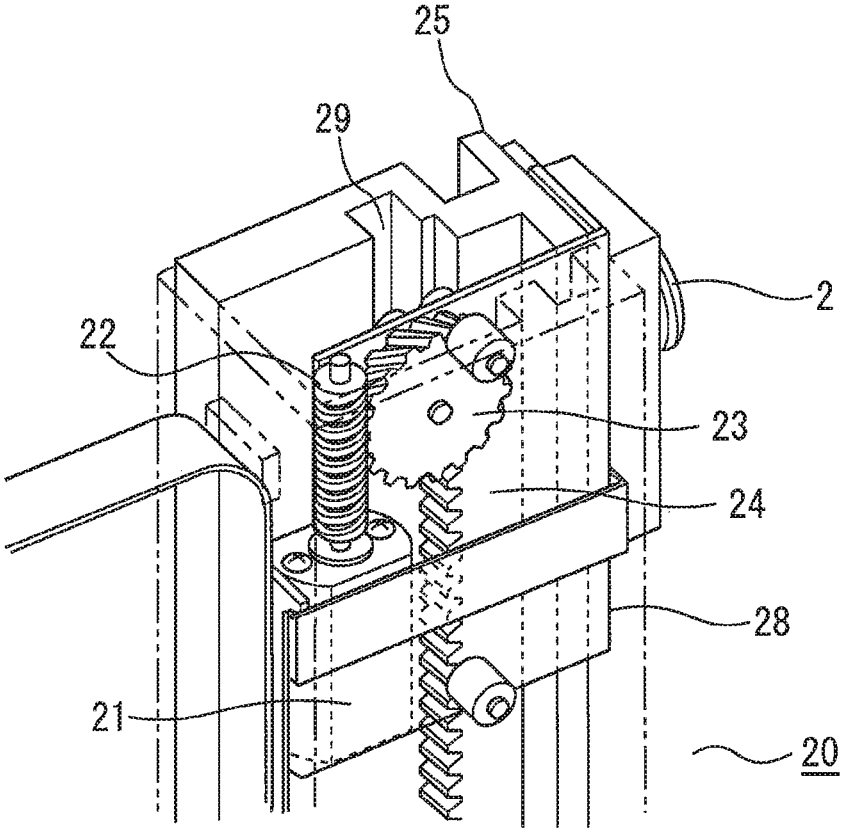
FIG. 4 is an enlarged perspective view transparently illustrating a main part of the camera moving device according to Embodiment 1 of the present invention.
Figure 5:
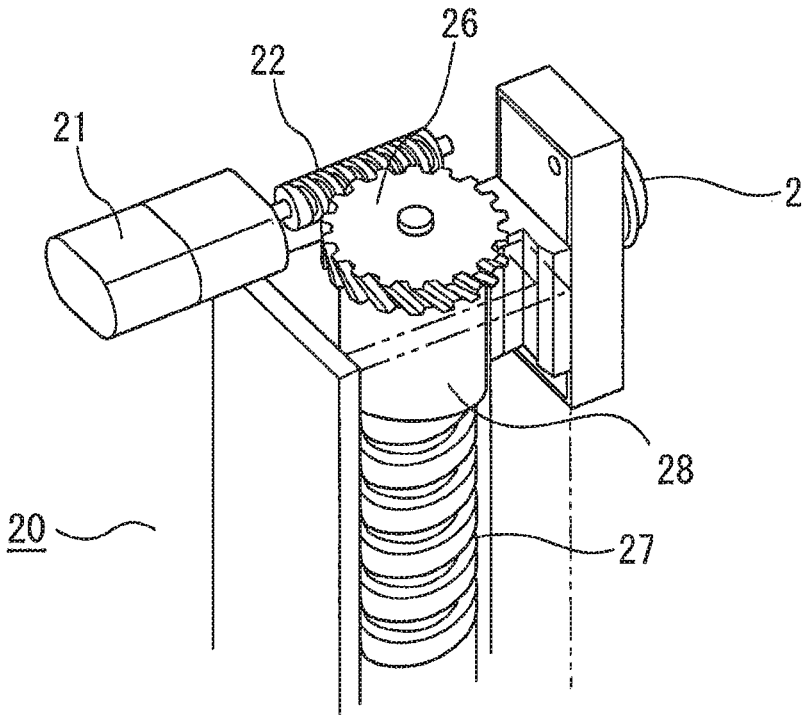
FIG. 5 is an enlarged perspective view transparently illustrating a main part of another example of the camera moving device according to Embodiment 1 of the present invention.
Figure 6:
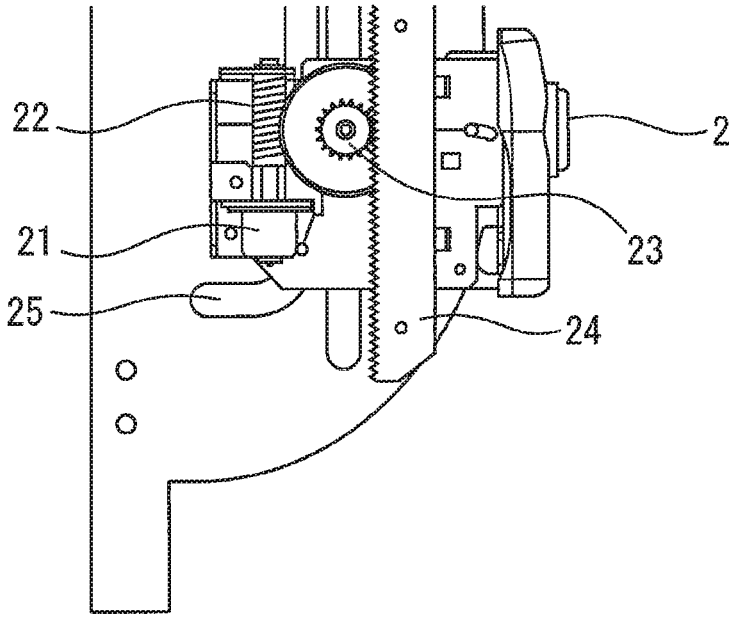
FIG. 6 to FIG. 8 are diagrams to explain motion at a lowermost part of the camera moving device according to Embodiment 1 of the present invention.
Figure 7:
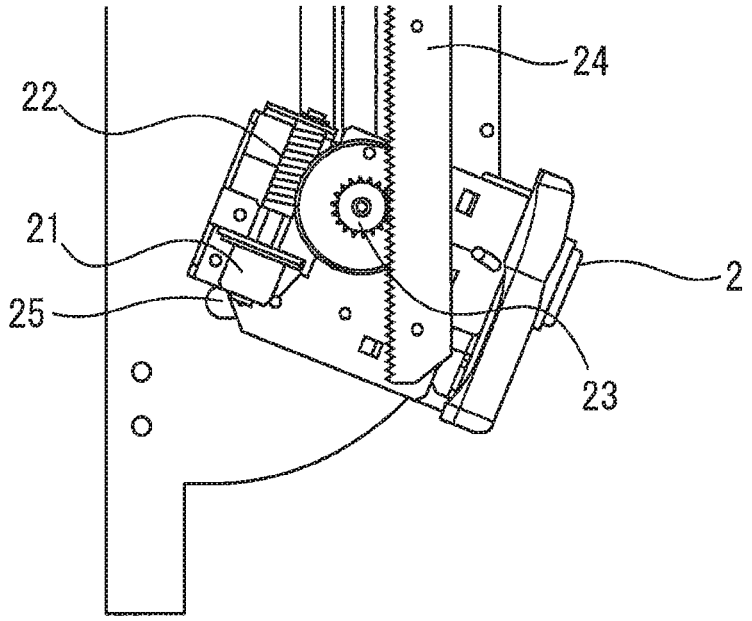
Figure 8:
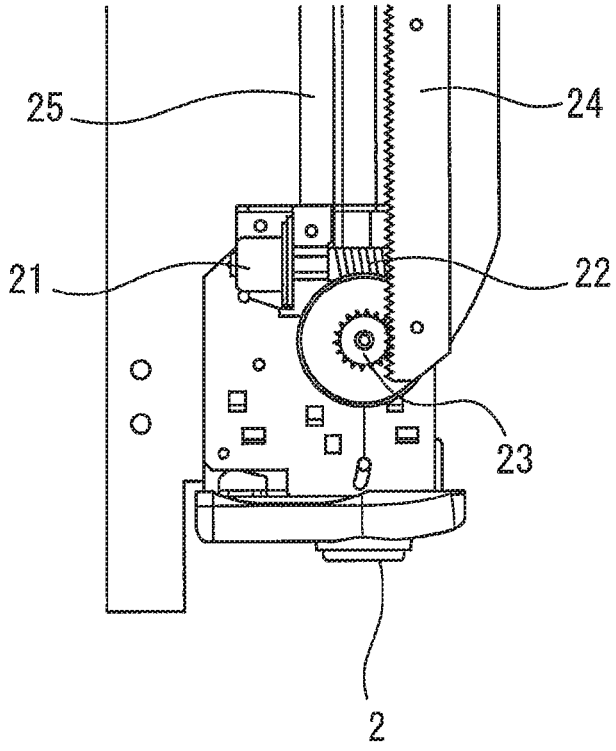
Figure 9:
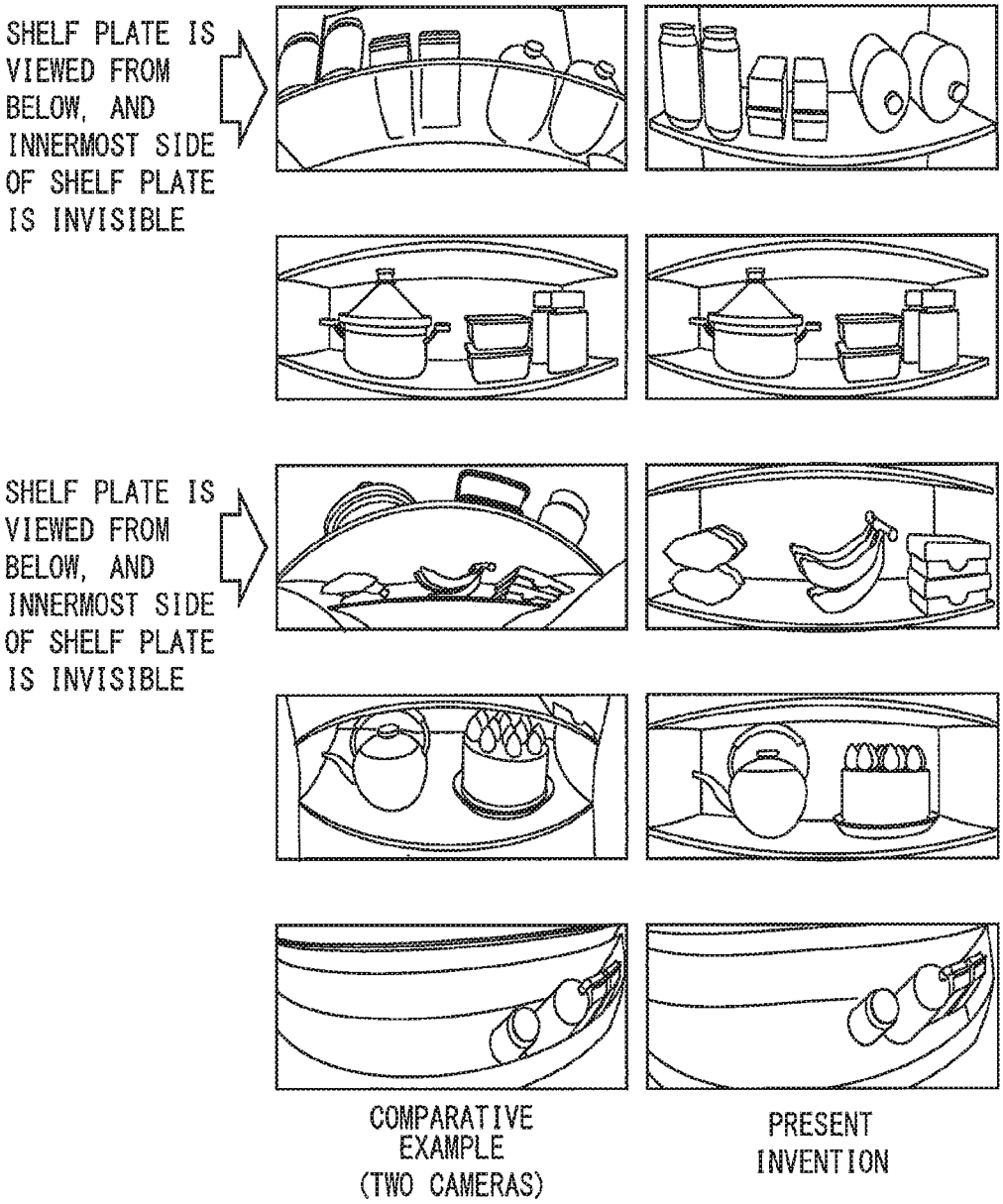
FIG. 9 is a diagram illustrating an exemplary image of an inside of a storeroom of the refrigerator according to Embodiment 1 of the present invention with Comparative Example.
Figure 10:
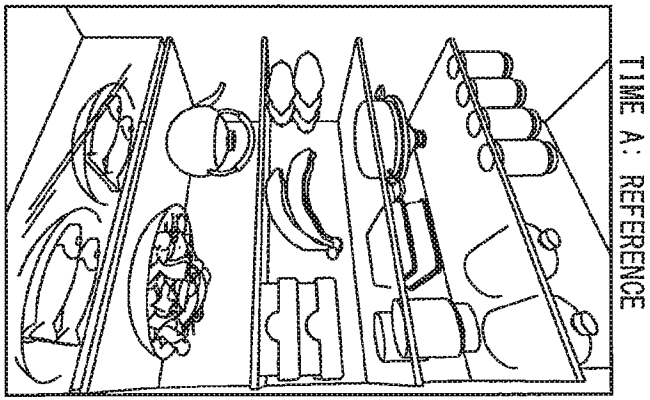
FIG. 10 is a diagram illustrating an exemplary image of the inside of the storeroom of the refrigerator according to Embodiment 1 of the present invention at time A.
Figure 11:
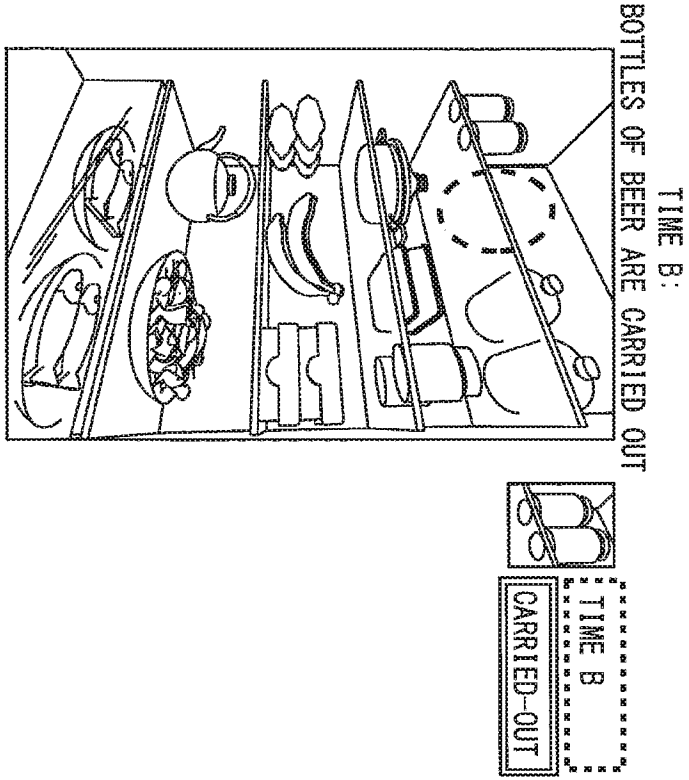
FIG. 11 is a diagram illustrating an exemplary image of the inside of the storeroom of the refrigerator according to Embodiment 1 of the present invention at time B.
Figure 12:
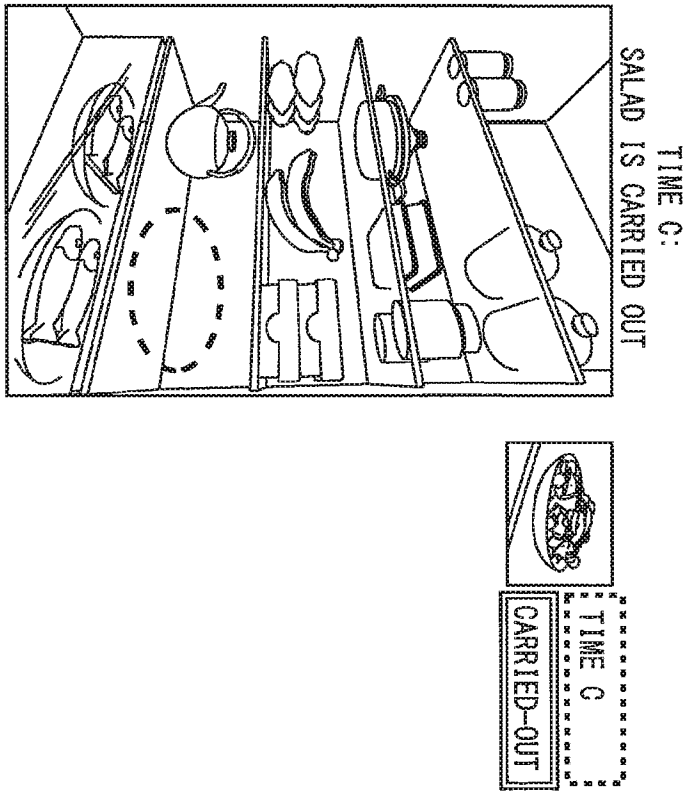
FIG. 12 is a diagram illustrating an exemplary image of the inside of the storeroom of the refrigerator according to Embodiment 1 of the present invention at time C.
Figure 13:
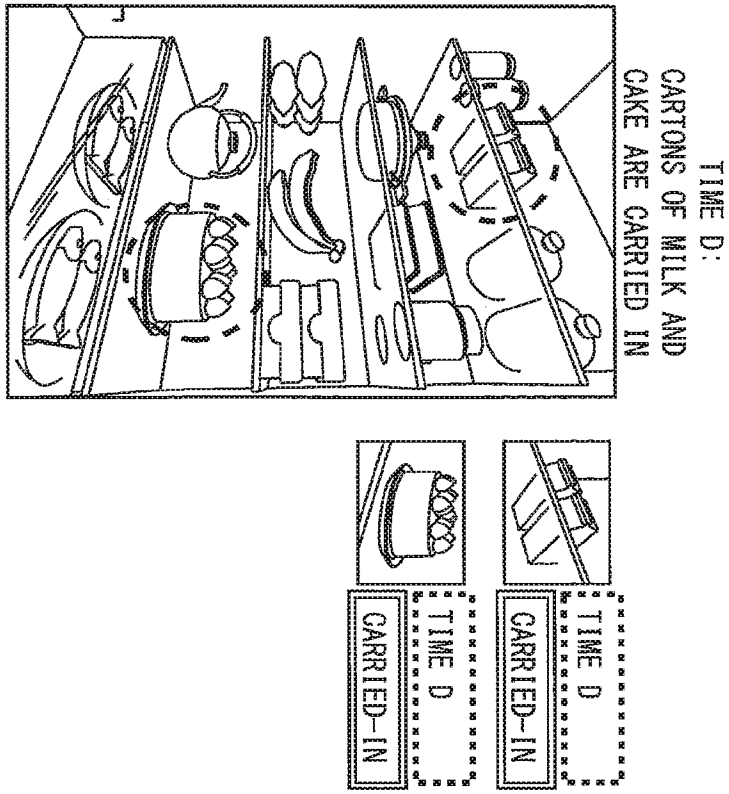
FIG. 13 is a diagram illustrating an exemplary image of the inside of the storeroom of the refrigerator according to Embodiment 1 of the present invention at time D.
Figure 14:
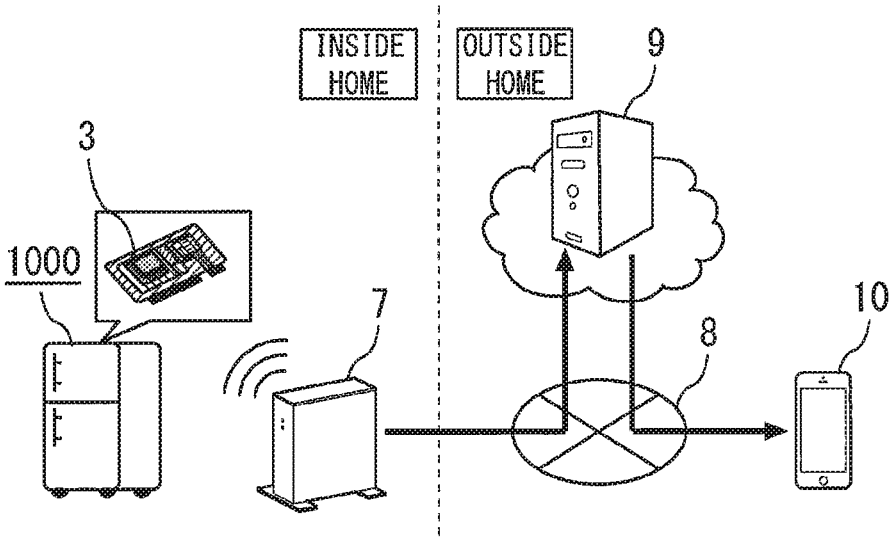
FIG. 14 is a diagram illustrating a configuration of a refrigerator system including the refrigerator according to Embodiment 1 of the present invention.
Figure 15:
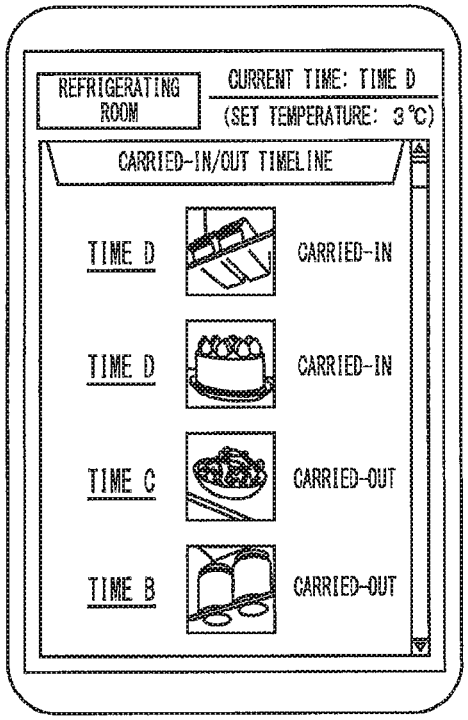
FIG. 15 to FIG. 17 are diagrams each illustrating a display example of a user terminal of the refrigerator system according to Embodiment 1 of the present invention.
Figure 16:
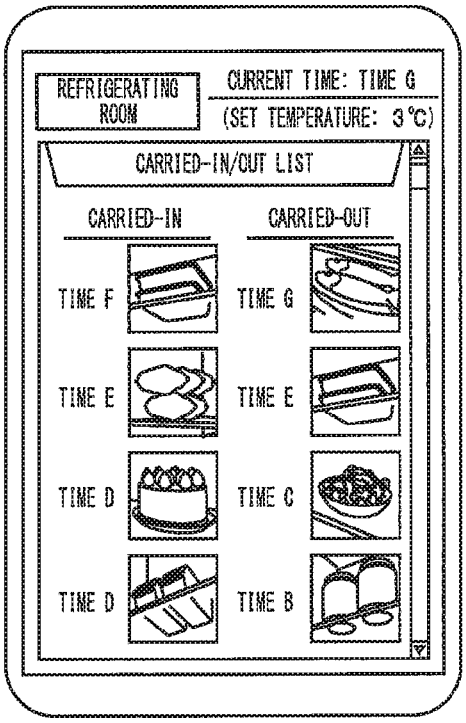
Figure 17:
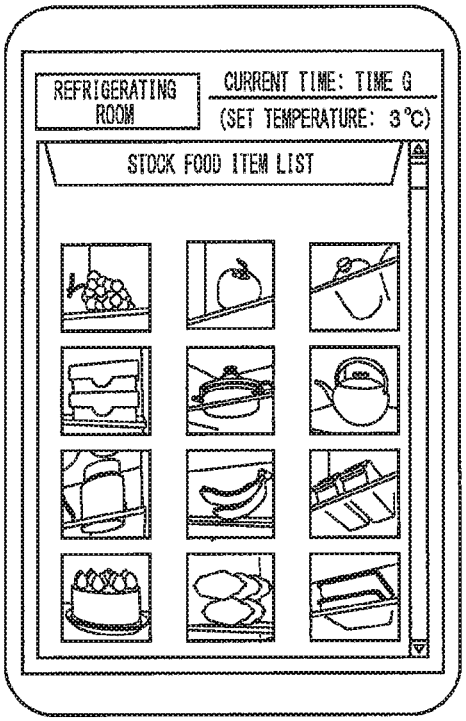

FIG. 1 to FIG. 18 relate to Embodiment 1 of the present invention. FIG. 1 is a front view of a refrigerator. FIG. 2 is a cross-sectional view of the refrigerator. FIG. 3 is a perspective view of a camera moving device of the refrigerator. FIG. 4 is an enlarged perspective view transparently illustrating a main part of the camera moving device. FIG. 5 is an enlarged perspective view transparently illustrating a main part of another example of the camera moving device. FIG. 6 to FIG. 8 are diagrams to explain motion at a lowermost part of the camera moving device. FIG. 9 is a diagram illustrating an exemplary image of an inside of a storeroom of the refrigerator with Comparative Example. FIG. 10 is a diagram illustrating an exemplary image of the inside of the storeroom of the refrigerator at time A. FIG. 11 is a diagram illustrating an exemplary image of the inside of the storeroom of the refrigerator at time B. FIG. 12 is a diagram illustrating an exemplary image of the inside of the storeroom of the refrigerator at time C. FIG. 13 is a diagram illustrating an exemplary image of the inside of the storeroom of the refrigerator at time D. FIG. 14 is a diagram illustrating a configuration of a refrigerator system including the refrigerator. FIG. 15 to FIG. 17 are diagrams each illustrating a display example of a user terminal of the refrigerator system. FIG. 18 is a diagram illustrating an example of contents stored in a food item image database of the refrigerator.

Note that, in the drawings, dimensional relationship, shapes, and the like of components may be different from those of actual components. Further, positional relationship (for example, vertical relationship) of the components in the specification is positional relationship in a case where a freezer refrigerator is installed in a usable state, in principle.

A refrigerator according to Embodiment 1 of the present invention includes a refrigerator main body 1000 illustrated in FIG. 1. In Embodiment 1, the refrigerator main body 1000 is provided with a refrigerating room 100, an ice making room 200, a switching room 300, a freezing room 400, and a vegetable room 500. The refrigerating room 100, the ice making room 200, the switching room 300, the freezing room 400, and the vegetable room 500 are storerooms each storing food items.

As illustrated in FIG. 1, these storerooms are disposed in order of the refrigerating room 100, the ice making room 200 and the switching room 300, the freezing room 400, and the vegetable room 500 from above. The ice making room 200 and the switching room 300 are disposed side by side at the same vertical position. A refrigerating room door 101 opening and closing the refrigerating room 100 is provided on a front surface of the refrigerating room 100. The refrigerating room door 101 is an example of a door configured to open and close a side of the storeroom. Further, each of the ice making room 200, the switching room 300, the freezing room 400, and the vegetable room 500 is configured so as to be drawn out forward from the refrigerator main body 1000 together with a door provided on a corresponding front surface.

An operation panel 1 is provided on the front surface of the refrigerating room door 101. The operation panel 1 includes a panel display unit 1*a*. The panel display unit 1*a* is a main body display unit that can display information. The panel display unit 1*a* can display internal information such as set temperature and current temperature of each of the storerooms. The panel display unit 1*a* includes, for example, a liquid crystal display. The operation panel 1 includes an operation unit such as a touch panel, a button, and a switch. A user can input necessary information by operating the operation unit of the operation panel 1. Note that an installation position of the operation panel 1 is not limited to the door of the refrigerating room 100, and the operation panel 1 may be provided on, for example, the door of any of the other storerooms, or a side surface of the refrigerator main body 1000.

As illustrated in FIG. 2, the front surface side (left side of figure) of the refrigerating room 100 is closed by the refrigerating room door 101. Note that the cross-sectional view illustrated in FIG. 2 illustrates a cross-section taken along line A-A' in FIG. 1. One or more refrigerating-room shelf plates 102 are provided inside the refrigerating room 100. Here, a case where a plurality of refrigerating-room shelf plates 102 is provided is illustrated as an example. The inside of the refrigerating room 100 is partitioned by the refrigerating-room shelf plates 102 into a plurality of spaces (shelfs) in a vertical direction. Food items are put on each of the refrigerating-room shelf plates 102.

The refrigerating-room shelf plates 102 are supported by respective shelf-plate supporting units 103 at predetermined positions inside the refrigerating room 100. The shelf-plate supporting units 103 are provided to protrude inside the refrigerating room 100 from an inner surface of a side wall of the refrigerating room 100. Note that each of the shelf-plate supporting units 103 may be configured so as to change a vertical position of one refrigerating-room shelf plate 102.

A space below the lowermost refrigerating-room shelf plate 102 is a chilled room 110. A chilled case 111 is provided inside the chilled room 110. The chilled case 111 can be drawn out forward along a guide member (not illustrated) such as rails. Further, door pockets 104 are provided on an inner surface of the refrigerating room door 101. The food items can be put on and stored in the door pockets 104.

A camera 2 is installed on the inner surface of the refrigerating room door 101. The camera 2 takes an image of the inside of the storeroom (in this case, refrigerating room 100) from the refrigerating room door 101 side, and outputs the image as a storeroom image. The refrigerator main body 1000 according to Embodiment 1 of the present invention includes a camera moving device 20. The camera moving device 20 is a device to move the camera 2 in the vertical direction. The camera moving device 20 is provided on the inner surface of the refrigerating room door 101.

The camera moving device 20 moves the camera 2 in the vertical direction within a movable range. The movable range is a predetermined range. In this example, an upper end of the movable range is an upper end part of the inside of the refrigerating room 100. Further, a lower end of the movable range is a position just above the lowermost door pocket 104.

Next, a configuration of the camera moving device 20 is described with reference to FIG. 3 to FIG. 5. As illustrated in FIG. 3 and FIG. 4, the camera moving device 20 includes a stepping motor 21, a worm gear 22, a pinion 23, a rack 24, a guide unit 25, and a camera supporting unit 28. The camera 2 is fixed to the camera supporting unit 28. The guide unit 25 is fixed to the refrigerating room door 101. The camera supporting unit 28 is movable to the guide unit 25. The guide unit 25 is disposed along the vertical direction at least over the above-described movable range. The guide unit 25 guides movement of the camera 2 and the camera supporting unit 28 over the above-described movable range.

As illustrated in FIG. 4, the stepping motor 21, the worm gear 22, and the pinion 23 are attached to the camera supporting unit 28. The rack 24 is attached to the guide unit 25. The rack 24 is disposed along the vertical direction over the above-described movable range. Further, the guide unit 25 is provided with a groove 29. The groove 29 is provided over the above-described movable range.

The stepping motor 21 drives moving the camera 2. The worm gear 22 is fixed to a drive shaft of the stepping motor 21. The pinion 23 includes a large gear and a small gear that are integrated. The large gear and the small gear of the pinion 23 are fixed so as to rotate around the same rotary shaft. The large gear of the pinion 23 engages with the worm gear 22. The small gear of the pinion 23 engages with the rack 24.

When the worm gear 22 is rotated by the stepping motor 21, the pinion 23 rotates. When the pinion 23 engaging with the rack 24 rotates, the rotary shaft of the pinion 23 linearly moves along the rack 24. The rotary shaft of the pinion 23 is rotatably supported by the camera supporting unit 28. Therefore, the camera moving device 20 converts rotational motion of the stepping motor 21 into linear motion of the camera supporting unit 28 to the guide unit 25 by such a rack and pinion mechanism, and moves the camera 2 in the vertical direction relative to the refrigerating room door 101.

Note that a moving amount of the camera 2 is proportional to a rotational amount of the stepping motor 21. Further, the rotational amount of the stepping motor 21 can be controlled with use of the number of steps. Accordingly, the camera moving device 20 can control the moving amount of the camera 2 with use of the number of steps of the stepping motor 21.

FIG. 5 illustrates another example of the configuration of the camera moving device 20. In this example, the camera 2 is moved by a feed screw mechanism. In this example, the camera moving device 20 includes the stepping motor 21, the worm gear 22, a worm wheel 26, a feed screw 27, and the camera supporting unit 28.

The worm gear 22 is fixed to the drive shaft of the stepping motor 21. The worm wheel 26 engages with the worm gear 22. The feed screw 27 is coupled with the worm wheel 26 so as to rotate around the same rotary shaft. The feed screw 27 is disposed along the vertical direction over the above-described movable range. The camera supporting unit 28 is attached to the feed screw 27. A female thread engaging with a thread of the feed screw 27 is provided on the camera supporting unit 28. The camera 2 is fixed to the camera supporting unit 28.

When the worm gear 22 is rotated by the stepping motor 21, the worm wheel 26 and the feed screw 27 rotate. When the feed screw 27 rotates, the camera supporting unit 28 linearly moves along the rotary shaft of the feed screw 27 by screw action. The camera moving device 20 converts the rotational motion of the stepping motor 21 into the linear motion of the camera supporting unit 28 by such a feed screw mechanism, and moves the camera 2 in the vertical direction relative to the refrigerating room door 101.

Next, the configuration of the camera moving device 20 at a lower end part of the above-described movable range, and operation when the camera moving device 20 moves the camera 2 to the lower end of the above-described movable range are described with reference to FIG. 6 to FIG. 8. As described above, the groove 29 is provided in the guide unit 25 over the above-described movable range. As illustrated in these figures, the groove 29 is smoothly curved from the vertical direction toward the refrigerating room door 101 side at the lower end part of the above-described movable range. The groove 29 extends along the vertical direction at the other part.

An unillustrated protrusion provided on the camera supporting unit 28 is inserted into the groove 29. The protrusion is provided on the refrigerating room door 101 side of the pinion 23. When the pinion 23 rotates on the rack 24, the protrusion of the camera supporting unit 28 moves inside the groove 29 while being regulated inside the groove 29, which determines the direction of the camera supporting unit 28, namely, the direction of the camera 2.

As illustrated in FIG. 6, at the part where the groove 29 extends along the vertical direction, even when the camera supporting unit 28 moves, the direction of the camera 2 is maintained to a direction opposite to the refrigerating room door 101. When the camera 2 continues to move downward and the protrusion of the camera supporting unit 28 approaches a curve of the groove 29, the pinion 23 of the camera supporting unit 28 tries to continue the downward move, whereas the protrusion of the camera supporting unit 28 is guided by the groove 29 and stops the downward move, and starts to move to the refrigerating room door 101 side. Accordingly, the camera supporting unit 28 starts to incline and the camera 2 starts to be directed downward, as illustrated in FIG. 7.

When the camera 2 reaches the lower end of the above-described movable range, the camera 2 is directed right below as illustrated in FIG. 8. As described above, the lower end of the movable range is just above the door pocket 104. Therefore, the camera 2 located at the lower end of the movable range can take an image of the inside of the door pocket 104 from above. As described above, the camera moving device 20 can move the camera 2 to the position and the direction in which the camera 2 can take an image of the inside of the door pocket 104 from above.

The camera 2 takes an image of the inside of the refrigerating room 100, for example, when the refrigerating room door 101 is opened and closed. This is because, when the refrigerating room door 101 is opened and closed, a food item may be carried in or out of the refrigerating room 100, and the storage state inside the refrigerating room 100 may be changed. The refrigerator main body 1000 includes a sensor that can detect opening and closing of the door. The sensor is, for example, a common magnet sensor. Therefore, for example, the sensor detects approaching of a magnet embedded in the refrigerating room door 101, by paired reed switches installed in the refrigerator main body 1000 side. For example, the camera 2 detects that the opened refrigerating room door 101 has been closed, and then takes an image while the inside of the refrigerating room 100 is illuminated.

The camera 2 takes an image of the inside of the refrigerating room 100 in cooperation with moving of the camera 2 by the camera moving device 20. Next, the image taking operation by cooperation between the camera 2 and the camera moving device 20 is described. To take an image of the inside of the refrigerating room 100, the camera moving device 20 moves the camera 2 from one end to the other end of the above-described movable range while stopping moving the camera 2 on the way. Further, the camera 2 takes an image at each time when the camera moving device 20 stops moving the camera 2.

For example, the camera moving device 20 moves the camera 2 downward from the upper end to the lower end of the above-described movable range. At this time, the camera moving device 20 stops the camera 2 at least one point between an inner surface of a top edge of the refrigerating room 100 and the refrigerating-room shelf plate 102 located adjacent to the inner surface of the top edge. Further, the camera 2 takes an image while being stopped at this position. The image taken by the camera 2 at this time shows the storage state of the refrigerating-room shelf plate 102 located adjacent to the inner surface of the top edge of the refrigerating room 100, namely, the uppermost refrigerating-room shelf plate 102. After the camera 2 takes an image, the camera moving device 20 resumes the downward moving of the camera 2.

Further, the camera moving device 20 stops the camera 2 at least one point for each of between the refrigerating-room shelf plates 102 located adjacent to each other. The camera 2 takes an image while being stopped at this position. The image taken by the camera 2 at this time shows the storage state of the refrigerating-room shelf plate 102 just below the position of the camera 2. After the camera 2 takes an image, the camera moving device 20 resumes the downward moving of the camera 2.

When the camera 2 reaches the lower end of the above-described movable range in the above-described manner, the camera 2 is located at the position and the direction in which the camera 2 can take an image of the inside of the door pocket 104 from above. Further, the camera 2 takes an image while being stopped at this position. The image taken by the camera 2 at this time shows the storage state of the lowermost door pocket 104.

The camera 2 takes an image when being located at the position between the refrigerating-room shelf plates 102 lain next to each other in the above-described manner. Further, the camera 2 takes an image also when being located at the position between the inner surface of the top edge of the refrigerating room 100 and the refrigerating-room shelf plate 102 lain next to the inner surface of the top edge. Moreover, in Embodiment 1, the camera 2 takes an image of the inside of the door pocket 104 from above. Note that the camera moving device 20 may move the camera 2 upward from the lower end to the upper end of the above-described movable range.

In Embodiment 1, the camera moving device 20 controls the position of the camera 2 within the above-described movable range with use of the number of steps of the stepping motor 21. In other words, the camera moving device 20 specifies the position where the camera 2 is stopped, by counting the number of steps of the stepping motor 21.

In a case where the positions of the refrigerating-room shelf plates 102 are fixed and are not changeable, the positions where the camera 2 is stopped are also fixable. Therefore, for example, the camera moving device 20 previously stores information about the positions where the camera 2 is stopped, for example, the number of steps of the stepping motor 21. The camera moving device 20 may stop the camera 2 when the number of steps of the stepping motor 21 becomes a previously-stored value.

Further, in a case where the positions of the refrigerating-room shelf plates 102 are changeable, the current positions of the refrigerating-room shelf plates 102 may be specified in the following manner, and the positions where the camera 2 is stopped may be determined. As a first example, there is a method of providing means for detecting the positions of the refrigerating-room shelf plate 102 on the respective shelf-plate supporting units 103. As specific means for detecting the positions of the refrigerating-room shelf plates 102, for example, micro switches may be used. In this case, the micro switches are installed so as to be pressed by the refrigerating-room shelf plates 102 when the refrigerating-room shelf plates 102 are disposed at appropriate positions of the respective shelf-plate supporting units 103. Further, the positions of the refrigerating-room shelf plates 102 can be detected based on the pressed micro switches.

As a second example, there is a method of specifying the positions of the refrigerating-room shelf plates 102 with use of the images taken by the camera 2. In this method, first, the camera 2 takes an image while the camera moving device 20 moves the camera 2 over the above-described movable range. The image taking positions at this time are not particularly limited as long as the entire range of the refrigerating room 100, an image of which can be taken by the camera 2, is eventually covered. Further, the images taken in the above-described manner are analyzed to specify the current positions of the refrigerating-room shelf plates 102.

Note that, when the sensor that detects opening and closing of the refrigerating room door 101 detects the closing operation of the refrigerating room door 101, the camera moving device 20 preferably moves the camera 2 to one end of the above-described movable range to perform zero point correction of the stepping motor 21. More specifically, when the sensor detects the closing operation of the refrigerating room door 101, the camera moving device 20 first moves the camera 2 to, for example, the upper end of the above-described movable range. Further, the camera moving device 20 sets the count value of the number of steps of the stepping motor 21, to zero. This makes it possible to correct deviation between the number of steps of the stepping motor 21 and the actual position of the camera 2.

The description is continued with reference to FIG. 2 again. The refrigerator main body 1000 includes a control substrate 1001. The control substrate 1001 is housed in, for example, an upper part on a rear surface side of the refrigerator main body 1000. The control substrate 1001 includes a control circuit that performs various kinds of control necessary for operation of the refrigerator main body 1000, and the like. The control substrate 1001 includes, for example, a microcomputer, namely, a processor and a memory. When the processor executes a program stored in the memory, the control substrate 1001 performs predetermined processing to control the refrigerator main body 1000.

The refrigerator system according to Embodiment 1 of the present invention first includes the refrigerator main body 1000 having the above-described configuration. The refrigerator system further includes an image server 3. The image server 3 performs storage, management, and transmission to outside, of the storeroom image. The image server 3 is installed inside a home where the refrigerator main body 1000 is installed (hereinafter, simply referred to as "inside home") and outside the storeroom of the refrigerator main body 1000. FIG. 1 and FIG. 2 illustrate an example in which the image server 3 is disposed on an outer surface of a ceiling part of the refrigerator main body 1000. Note that the installation position of the image server 3 is not limited to the ceiling part of the refrigerator main body 1000. The image server 3 may be installed on the side surface or a rear surface of the refrigerator main body 1000 or on the door of the storeroom as long as the installation position is outside the storeroom of the refrigerator main body 1000. Moreover, the image server 3 may be mounted on the control substrate 1001.

The image server 3 includes, for example, a microcomputer as with the above-described control substrate 1001, namely, includes a processor and a memory. Further, as illustrated in FIG. 2, the image server 3 includes a storeroom image storage unit 4, a storeroom image management unit 5, and a wireless communication unit 6. Functions of the respective units are realized, for example, when the processor executes a program stored in the memory and performs predetermined processing in the microcomputer of the image server 3. Note that the image server 3 is connected to, for example, the control substrate 1001, and operates by receiving power from the control substrate 1001.

The storeroom image storage unit 4 stores the storeroom image output from the camera 2. As described above, when opening and closing of the refrigerating room door 101 are detected, the camera 2 takes an image showing the storage state of each of the refrigerating-room shelf plates 102 and the lowermost door pocket 104 inside the refrigerating room 100 in cooperation with the camera moving device 20. The camera 2 outputs the taken images to the storeroom image storage unit 4. The images output from the camera 2 are input to the storeroom image storage unit 4.

Accordingly, the images output from the camera 2 are input to the storeroom image storage unit 4 at each time when the refrigerating room door 101 is opened and closed (namely, at each time when storage state inside refrigerating room 100 may be changed). In the above-described manner, the images of the inside of the refrigerating room 100 in the latest state are constantly input to the storeroom image storage unit 4.

The storeroom image storage unit 4 temporarily stores the input latest storeroom image. At this time, the storeroom image storage unit 4 temporarily stores, as image-taking time information, a time at which the storeroom image is input to the storeroom image storage unit 4, together with the storeroom image. Note that the image-taking time information includes information about an image-taking date (day and month, or day, month, and year).

Characteristics of the images taken by the refrigerator main body 1000 according to Embodiment 1 are described with reference to FIG. 9 while contrasting with a Comparative Example. Five images on a right side on a paper surface of FIG. 9 are exemplary images showing the storage state of the refrigerating-room shelf plates 102 and the lowermost door pocket 104, taken by the refrigerator main body 1000 according to Embodiment 1.

Further, five images on a left side are exemplary images showing the storage state of the refrigerating-room shelf plates 102 and the lowermost door pocket 104 according to the Comparative Example. In the Comparative Example, two cameras are provided at respective fixed positions. To take the images showing the storage state of all of the refrigerating-room shelf plates 102 and the lowermost door pocket 104 by the two cameras, a fisheye lens is used for each of the cameras.

In the Comparative Example, a refrigerating-room shelf plate 102 deviated from the front of each of the cameras is present. Therefore, distortion is large particularly in an uppermost image and a third image from above in the example of FIG. 9. Further, in these images, the corresponding refrigerating-room shelf plate 102 is viewed from below. Accordingly, it is difficult to check the storage state on the innermost side from the images. Further, these images are not suitable for image recognition to determine the storage state.

In contrast, in the images taken by the refrigerator main body 1000 according to Embodiment 1, distortion is small in the images of all of the refrigerating-room shelf plates 102 as compared with the Comparative Example. Further, the storage state on the innermost side is easily checked. Therefore, the images are used to image recognition, which allows for more accurate determination of the storage state.

As described above, in the refrigerator main body 1000 according to Embodiment 1, the camera moving device 20 that moves the camera 2 in the vertical direction stops the camera 2 at least one point for each of between the shelf plates located adjacent to each other and between the inner surface of the top edge of the storeroom and the shelf plate located adjacent to the inner surface of the top edge. The camera 2 takes an image at each time when the camera moving device 20 stops moving the camera 2. Accordingly, it is possible to suppress blurring and distortion of the image and to acquire the clearer storeroom image showing the innermost side of each of the shelf plates by the smaller number of cameras. Further, using the images acquired in the above-described manner in the image recognition allows for more accurate determination of the storage state inside the storeroom.

The description is continued with reference to FIG. 2 again. In the storeroom image storage unit 4, the latest images showing the storage state of the refrigerating-room shelf plates 102 and the lowermost door pocket 104 as described above are stored. The storeroom image management unit 5 acquires, from the storeroom image storage unit 4, the storeroom images and the image-taking time information stored in the storeroom image storage unit 4.

In the storeroom images stored in the storeroom image storage unit 4, however, slight distortion may occur due to characteristics of the lens of the camera 2. Further, brightness may differ between the images depending on illumination and the storage state inside the refrigerating room 100. Accordingly, as necessary, the storeroom image management unit 5 corrects one or both of brightness and distortion of the images taken by the camera 2. In other words, in this sense, the storeroom image management unit 5 serves as an image processing unit that corrects one or both of brightness and distortion of the images taken by the camera 2.

The storeroom image management unit 5 synthesizes the latest image of the inside of the whole refrigerating room 100 from the latest images showing the storage state of the refrigerating-room shelf plates 102 corrected as necessary. Further, the storeroom image management unit 5 rearranges the synthesized storeroom images in order of the image-taking time based on the image-taking time information, and stores the images. The storeroom images taken by the camera 2 are temporarily stored in the storeroom image storage unit 4, and are then moved to and managed by the storeroom image management unit 5 in the above-described manner.

Further, the storeroom image management unit 5 stores and manages images of food items taken by the camera 2 in time series after determining a distinction between carried-in and carried-out. For example, the storeroom image management unit 5 first extracts images of respective food items from the images taken by the camera 2. Next, the storeroom image management unit 5 compares the images at two consecutive time points, of each of the food items extracted from the images taken by the camera 2, thereby determining whether each of the food items has been carried in or out of the refrigerating room 100. At this time, the approximate carried-in date and time and the approximate carried-out date and time can be specified from the image-taking date and time of the two images used for the determination of the distinction between carried-in and carried-out. In the above-described manner, the storeroom image management unit 5 specifies the carried-in date and time and the carried-out date and time of the images of the respective food items based on the images taken by the camera 2, and stores and manages the images of the respective food items in time series.

Next, a specific example to determine the distinction between carried-in and carried-out of the food items based on the images taken by the camera 2 is described with reference to FIG. 10 to FIG. 13. FIG. 10 illustrates an example of the image of the inside of the refrigerating room 100 at time A. The time A is regarded as a reference time to determine the distinction between carried-in and carried-out.

FIG. 11 illustrates an example of the image of the inside of the refrigerating room 100 at time B. The time B is a time later than the time A. The storeroom image management unit 5 takes difference between the image of the inside of the refrigerating room 100 at the time A and the image of the inside of the refrigerating room 100 at the time B, thereby determining that two bottles of beer have been carried out of the top refrigerating-room shelf plate 102. The storeroom image management unit 5 extracts an image of the two bottles of beer from the image at the time A. Further, the storeroom image management unit 5 stores the distinction between carried-in and carried-out, namely, "carried-out" and the carried-out time B, together with the extracted image.

FIG. 12 illustrates an example of the image of the inside of the refrigerating room 100 at time C. The time C is a time later than the time B. The storeroom image management unit 5 takes difference between the image of the inside of the refrigerating room 100 at the time B and the image of the inside of the refrigerating room 100 at the time C, thereby determining that a salad has been carried out of the second refrigerating-room shelf plate 102 from below. The storeroom image management unit 5 extracts an image of the salad from the image at the time A or the image at the time B. Further, the storeroom image management unit 5 stores the distinction between carried-in and carried-out, namely, "carried-out" and the carried-out time C in this case, together with the extracted image.

FIG. 13 illustrates an example of the image of the inside of the refrigerating room 100 at time D. The time D is a time later than the time C. The storeroom image management unit 5 takes difference between the image of the inside of the refrigerating room 100 at the time C and the image of the inside of the refrigerating room 100 at the time D, thereby determining that two cartons of milk have been carried in the top refrigerating-room shelf plate 102 and a cake has been carried in the second refrigerating-room shelf plate 102 from below. The storeroom image management unit 5 extracts an image of the two cartons of milk and an image of the cake from the image at the time D. Further, the storeroom image management unit 5 stores the distinction between carried-in and carried-out, namely, "carried-in" and the carried-in time D in this case, together with the extracted images.

As described above, the storeroom image management unit 5 can determine whether or not a food item is carried in or out of the refrigerating room 100, based on the images taken by the camera 2.

The description is continued with reference to FIG. 2 again. The wireless communication unit 6 is a communication device communicable with outside. The wireless communication unit 6 performs mutual communication of information between the image server 3 of the refrigerator main body 1000 and a router device 7 with use of, for example, a well-known wireless communication technology. Note that the communication method between the image server 3 and the router device 7 is not limited to the wireless method, and may be a wired method.

FIG. 14 illustrates an entire configuration of the refrigerator system according to Embodiment 1 of the present invention. As illustrated in this figure, the refrigerator system according to Embodiment 1 of the present invention includes a user terminal 10. The user terminal 10 is a terminal device provided to be communicable with the wireless communication unit 6 as the communication device. Specific examples of the user terminal 10 include a PC, a smartphone, and a tablet terminal. Note that the number of user terminals 10 is one or more, desirably, two or more.

The user terminal 10 includes an unillustrated terminal display unit. The terminal display unit includes, for example, a liquid crystal display. Further, the terminal display unit may be configured by a touch panel that displays information and receive operation from a user. The terminal display unit of the user terminal 10 can display the storeroom images and various kinds of information including the image-taking time information.

As illustrated in FIG. 14, the refrigerator main body 1000, the image server 3, and the router device 7 are installed inside the home. The router device 7 is communicably connected to a cloud server 9 through, for example, the Internet 8. The cloud server 9 is the above-described external server. In this figure, a case where the cloud server 9 that includes a plurality of servers (server group) connected to the Internet 8 is used as the external server is illustrated. The external server, however, is not limited to the cloud server 9, and may be one server. The Internet 8 and the cloud server 9 are located outside the home where the refrigerator main body 1000 is installed (hereinafter, simply referred to as "outside home").

The wireless communication unit 6 transmits the images and the information stored in the storeroom image storage unit 4 and the storeroom image management unit 5 to the cloud server 9 outside the home through the router device 7 and the Internet 8. Further, the cloud server 9 stores the received images and information.

At this time, assuming a case where communication with the cloud server 9 congests and the storeroom images cannot be uploaded (transmitted) at one time, the maximum number of retrial times for upload of the storeroom images from the wireless communication unit 6 to the cloud server 9 may be set. Further, in a case where the number of retrial times reaches the maximum number of retrial times, the wireless communication unit 6 may immediately upload the storeroom images.

The user terminal 10 outside the home accesses the cloud server 9 through the Internet 8. When the user performs operation to display the images and the information relating to the refrigerator main body 1000 on the user terminal 10, the user terminal 10 transmits a transmission request. The cloud server 9 having received the transmission request transmits the images and the information stored in the cloud server 9, to the user terminal 10. The user terminal 10 receives the images and the information from the cloud server 9 through the Internet 8. Further, the user terminal 10 displays the received images and the information relating to the refrigerator main body 1000, on the terminal display unit.

Note that the user terminal 10 may receive the images and the information relating to the refrigerator main body 1000 transmitted from the wireless communication unit 6 through the router device 7 and the Internet 8 without through the external server such as the cloud server 9. Further, in a case where the storeroom image management unit 5 determines that any food item has been carried in or out of the refrigerating room 100, the wireless communication unit 6 may notify the user terminal 10 that any food item has been carried in or out of the refrigerating room 100, through the router device 7 and the internet 8.

FIG. 15 to FIG. 17 each illustrate an example of a screen displayed on the user terminal 10. FIG. 15 illustrates a display example of a "carried-in/out timeline". As described above, the storeroom image management unit 5 of the image server 3 stores the carried-in/out date and time, the distinction between carried-in and carried-out, and the images of the carried-in/out food items based on the images of the inside of the refrigerating room 100 taken by the camera 2. The carried-in/out timeline is a screen that displays the images and the information arranged in time series.

FIG. 16 illustrates a display example of a "carried-in/out list". As with the carried-in/out timeline, the carried-in/out list also displays the carried-in/out date and time, the distinction between carried-in and carried-out, and the images of the carried-in/out food items that are stored in the storeroom image management unit 5 of the image server 3. However, the carried-in/out list and the carried-in/out timeline are different in display format from each other. The carried-in/out list is a screen that displays the carried-in/out date and time and the images of the carried-in/out food items in a list format while classifying the food items into a column of the "carried-in" food items and a column of the "carried-out" food items.

FIG. 17 illustrates a display example of a "stock food item list". As described above, the storeroom image management unit 5 of the image server 3 extracts the images of the respective food items from the images of the inside of the refrigerating room 100 taken by the camera 2, and stores the images. The stock food item list is a screen that displays the images of the respective food items stored in the refrigerating room 100 at a certain time in a list format.

Note that the screens of the "carried-in/out timeline", the "carried-in/out list", and the "stock food item list" can be also displayed on the panel display unit 1*a* of the operation panel 1. Further, the panel display unit 1*a* may display, in addition to these screens, various kinds of images and information managed by and stored in the storeroom image management unit 5, the images stored in the storeroom image storage unit 4, and the like.

The storeroom image management unit 5 may determine a type and an amount of each of the food items inside the refrigerating room 100 from the images taken by the camera 2, in addition to extraction of the images of the respective food items inside the refrigerating room 100 from the images taken by the camera 2. To perform the determination, the storeroom image management unit 5 previously stores a food item image database. The food item image database is a set of data in which each of food types is associated with at least one of a shape, a size, a color, and a package label of the corresponding food item. In this sense, the storeroom image management unit 5 includes a food item information storage unit that previously stores each of the food types in association with at least one of the shape, the size, the color, and the package label of the corresponding food item.

A specific example of the information stored in the food item image data base is described with reference to FIG. 18. The food item image database stores a characteristic attribute of each of the food types. The characteristic attribute allows for distinction of each of the food types from the other food types. In this example, the food item image database stores a characteristic amount of a food item itself belonging to each of the food types or a characteristic amount of a container containing the food item, in association with each of the food types. More specifically, information about a shape (outline), a size of a long axis, a representative color (RGB value), a label (characters), and the like is used as the characteristic amount of each of the food types.

Note that the shape of each of the food types stored in the food item image database may be, for example, a geometric shape (for example, column or trapezoid) closest to an outer shape of the food item, in addition to the outline described as an example. In this case, in the determination by the storeroom image management unit 5, for example, collation with the shape stored in the food item image database is performed by, for example, pattern matching. Further, as for the color, the other index value such as lightness and saturation may be used in addition to the RGB value of the representative color.

The storeroom image management unit 5 determines the type and the amount of each of the food items inside the storeroom (in this case, refrigerating room 100) based on the images stored in and managed by the storeroom image management unit 5 while referring to the information stored in the food item image database as described above. In this determination, the storeroom image management unit 5 collates whether each of the images of the respective food items extracted from the images taken by the camera 2 is coincident with the characteristic amount of which food type among the food types stored in the food item image database.

In a case where the characteristic amount coincident with any of the images of the food items is present in the food item image database, the storeroom image management unit 5 determines that the food type of the image is a type associated with the coincident characteristic amount in the food item image database. Note that, in a case where data having the coincident characteristic amount is not present in the food item image database, the food type of the image may be substituted by a food type associated with the most similar characteristic amount, or the food item of the image may be identified only in size as an unknown type of stored item.

As described above, the storeroom image management unit 5 compares each of the images of the food items extracted from the images taken by the camera 2 with the characteristic amounts stored in the food item image database, thereby specifying the type and the amount of each of the food items stored in the refrigerating room 100.

Embodiment 2

Figure 19:
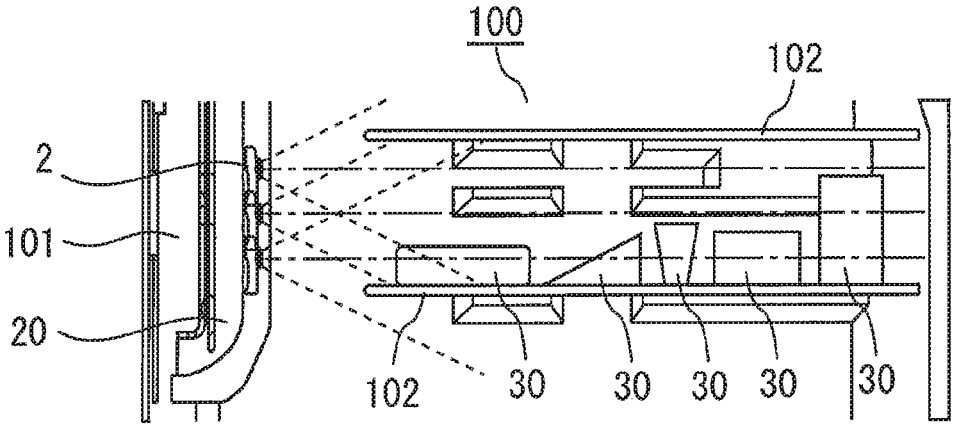
FIG. 19 is a main part cross-sectional view illustrating an example of an image taking position of a camera of a refrigerator according to Embodiment 2 of the present invention.

FIG. 19 is a main part cross-sectional view illustrating an example of an image taking position of a camera of a refrigerator according to Embodiment 2 of the present invention. In the following, a case where the refrigerator system according to Embodiment 2 basically has the configuration according to Embodiment 1 is taken as an example, and difference with Embodiment 1 is mainly described.

In Embodiment 2 described here, the camera moving device 20 stops the camera 2 at least two or more points for each of between the refrigerating-room shelf plates 102 located adjacent to each other and between the inner surface of the top edge of the refrigerating room 100 and the refrigerating-room shelf plate 102 located adjacent to the inner surface of the top edge, in the configuration according to Embodiment 1 described above. Further, the camera 2 takes an image at each time when the camera moving device 20 stops moving the camera 2.

In other words, the camera 2 takes an image at two or more different positions between the refrigerating-room shelf plates 102 lain next to each other. Further, the camera 2 also takes an image at two or more different positions between the inner surface of the top edge of the refrigerating room 100 and the refrigerating-room shelf plate 102 lain next to the inner surface of the top edge.

FIG. 19 illustrates an example in which the camera 2 is stopped and takes an image at three points between the refrigerating-room shelf plates 102 lain next to each other. As illustrated in this figure, in a case where the camera 2 is stopped and takes an image at a relatively upper position between the refrigerating-room shelf plates 102 lain next to each other, the camera 2 can take an image of a food item 30 on an innermost side of the refrigerating-room shelf plate 102. Further, the camera 2 easily takes a clear image of a package upper surface of the food item 30. However, it is difficult for the camera 2 to take an image of a front surface of a food item 30 on a front side of the refrigerating-room shelf plate 102.

In contrast, in a case where the camera 2 is stopped and takes an image at a relatively lower position between the refrigerating-room shelf plates 102 lain next to each other, the camera 2 can take an image of the front surface of the food item 30 on the front side of the refrigerating-room shelf plate 102. In contrast, the food item 30 located on the innermost side of the refrigerating-room shelf plate 102 is hidden by the food item 30 on the front side.

Therefore, when the camera 2 takes an image of one refrigerating-room shelf plate 102 from a plurality of points different in the vertical direction, the camera 2 can take images of the larger number of food items from the front side to the innermost side of the refrigerating-room shelf plate 102.

In Embodiment 2, the storeroom image management unit 5 corrects one or both of brightness and distortion of the images taken by the camera 2 at the two or more positions higher than each of the refrigerating-room shelf plates 102 for the respective refrigerating-room shelf plates 102, and then synthesizes the corrected images to generate the image showing the food item storage state of each of the refrigerating-room shelf plates 102. Further, the storeroom image management unit 5 synthesizes the images showing the food item storage state of the respective refrigerating-room shelf plates 102 to generate the image of the inside of the whole refrigerating room 100.

Note that the other configuration is similar to the configuration according to Embodiment 1, and description of the configuration is omitted here.

The refrigerator system having the above-described configuration also can achieve effects similar to the effects by Embodiment 1. Further, since the images clearly showing the larger number of food items from the front side to the innermost side of the refrigerating-room shelf plates 102 can be acquired, the storage stage can be easily checked. Moreover, using the images acquired in such a manner in the image recognition allows for more accurate determination of the storage state inside the storeroom.

Industrial Applicability

The present invention can be used for the refrigerator including the camera that takes an image of the inside of the storeroom. Further, the present invention can be used for the refrigerator system that transmits the image of the inside of the storeroom to the outside of the refrigerator.

The invention claimed is:

1. A refrigerator comprising:

a main body having a storeroom for storing a food item;

a plurality of shelf plates arranged in the storeroom, the shelf plates being configured for placement of a food item thereon;

a door configured to open and close a side of the storeroom;

a camera arranged on an inner surface of the door, the camera being configured to take an image of an inside of the storeroom; and a camera moving device configured to move the camera in a vertical direction, the camera moving device being further configured to stop the camera at two or more points for each space between the shelf plates located adjacent to each other, and between an inner surface of a top edge of the storeroom and a shelf plate, of the plurality of shelf plates, located adjacent to the inner surface of the top edge of the storeroom, the camera being further configured to take an image at each time when the camera moving device stops moving the camera.

2. The refrigerator according to claim 1, further comprising an image processing unit configured to correct one or both of brightness and distortion of images taken by the camera at two or more positions higher than each of the shelf plates, and to then synthesize the corrected images to generate an image showing a food item storage state of each of the shelf plates.

3. The refrigerator according to claim 1, further comprising a door pocket provided on an inside of the door, wherein the camera moving device is further configured to move the camera to a position and a direction in which the camera takes an image of an inside of the door pocket from above.

4. The refrigerator according to claim 1, wherein the camera moving device includes a stepping motor configured to drive moving of the camera, moves the camera in the vertical direction within a predetermined movable range, and controls a position of the camera within the movable range with use of number of steps of the stepping motor.

5. The refrigerator according to claim 4, further comprising a sensor configured to detect opening and closing of the door, wherein in a case where the sensor detects closing operation of the door, the camera moving device moves the camera to one end of the movable range and performs zero point correction of the stepping motor.

6. A refrigerator system comprising:

the refrigerator according to claim 1;

a communication device configured to transmit the image taken by the camera; and a terminal device configured to communicate with the communication device and configured to receive the image taken by the camera transmitted from the communication device.

7. The refrigerator system according to claim 6, further comprising an image management unit configured to determine whether or not a food item is carried in or out of the storeroom, based on the image taken by the camera, wherein in a case where the image management unit determines that any food item has been carried in or out of the storeroom, the communication device notifies the terminal device that any food item has been carried in or out of the storeroom.

8. The refrigerator system according to claim 7, wherein the image management unit extracts an image of the food item that has been carried in or out of the storeroom from the image taken by the camera, and determines a distinction between carried-in and carried-out and a carried-in/out date and time, and the communication device transmits, to the terminal device, the image of the carried-in/out food item extracted from the image taken by the camera, and information on the distinction between carried-in and carried-out and the carried-in/out date and time.

9. The refrigerator system according to claim 8, wherein the terminal device is configured to display the image of the carried-in/out food item and the information on the distinction between carried-in and carried-out and the carried-in/out date and time, in time series.

10. The refrigerator system according to claim 8, wherein the terminal device is configured to display the image of the carried-in/out food item and the information on the distinction between carried-in and carried-out and the carried-in/out date and time while classifying the food item into the carried-in food item and the carried-out food item.

11. The refrigerator system according to claim 7, wherein the image management unit extracts images of respective food items inside the storeroom, from the image taken by the camera, the communication device transmits, to the terminal device, the images of the respective food items inside the storeroom, extracted from the image taken by the camera, and the terminal device is configured to display the images of the respective food items inside the storeroom.

12. The refrigerator system according to claim 7, wherein the image management unit stores a food type in association with at least one of a shape, a size, a color, and a package label of a corresponding food item in advance, and determines a type and an amount of each of the food items inside the storeroom from the image taken by the camera by referring to the stored information.

* * * * *